US005209649A

United States Patent [19]

Dose et al.

[11] Patent Number: 5,209,649

[45] Date of Patent: May 11, 1993

[54] CONTROL SYSTEM FOR A TWO-CYLINDER THICK MATTER PUMP

[75] Inventors: Rolf Dose, Filderstadt; Hartmut Benckert, Leinfeld-Echterdingen, both of Fed. Rep. of Germany

[73] Assignee: Putzmeister-Week Maschinenfabrik GMBH, Aichtal, Fed. Rep. of Germany

[21] Appl. No.: 613,491

[22] PCT Filed: Mar. 15, 1989

[86] PCT No.: PCT/EP89/00273

§ 371 Date: Nov. 27, 1990

§ 102(e) Date: Nov. 27, 1990

[87] PCT Pub. No.: WO89/11037

PCT Pub. Date: Nov. 16, 1989

[30] Foreign Application Priority Data

May 2, 1988 [DE] Fed. Rep. of Germany ..... 3814824

[51] Int. Cl.[5] ..... F04B 35/02

[52] U.S. Cl. ..... 417/342; 417/344; 417/900; 91/275; 91/295; 91/304

[58] Field of Search ..... 417/339, 342, 344, 900; 91/275, 291, 295, 304

[56] References Cited

U.S. PATENT DOCUMENTS

| | | | |
|---|---|---|---|
| 3,587,236 | 6/1971 | Bennett | 60/52 |
| 3,667,869 | 6/1972 | Schlecht | 417/900 |
| 4,105,373 | 8/1978 | Calzolari | 417/900 |
| 5,092,744 | 3/1992 | Boers et al. | 91/275 |
| 5,127,806 | 7/1992 | Beuckert | 417/900 |

FOREIGN PATENT DOCUMENTS

| | | |
|---|---|---|
| 2411391 | 9/1975 | Fed. Rep. of Germany . |
| 3243576A | 5/1984 | Fed. Rep. of Germany . |
| WO86/01260 | 2/1986 | Fed. Rep. of Germany . |

*Primary Examiner*—Richard A. Bertsch
*Assistant Examiner*—Charles G. Freay
*Attorney, Agent, or Firm*—Kenyon & Kenyon

[57] ABSTRACT

A two cylinder thick matter pump has two hydraulic drive cylinders, two pistons supported and driven within each respective drive cylinder, and two feed cylinders. Each feed cylinder is adapted to receive a respective piston therein to pump the matter therethrough. A hydro-pump is coupled to the drive cylinders to supply hydraulic fluid thereto. A reversing valve is coupled to the hydro-pump to reverse the direction thereof. Two pressure switching valves are coupled to one of the drive cylinders and to the reversing valve to actuate the reversing valve upon a change in cylinder pressure. Two electronic proximity switches are supported adjacent to the pistons and coupled to the reversing valve. The proximity switches actuate the reversing valve in parallel with the switching valves.

11 Claims, 2 Drawing Sheets

CONTROL SYSTEM FOR A TWO-CYLINDER THICK MATTER PUMP

FIELD OF THE INVENTION

The present invention relates to a control system for a two-cylinder thick matter pump.

BACKGROUND INFORMATION

Thick matter pumps typically have two feed pistons which are operated in a push-pull manner by hydraulic drive cylinders, and which lead into a material charge vessel. Each feed piston is coupled by a common piston rod with a respective drive piston of the respective drive cylinder, and their vessel-side openings are connectable with a feed line by means of a pipe switch. The pipe switch is pivotable by at least one hydro-cylinder, during the pressure stroke, and is open toward the interior of the vessel during the suction stroke.

At one end, the drive cylinders are pressurized alternately with high and low pressure by means of a hydro-pump, based on the position of a switching valve. The other ends of the drive cylinders are coupled together hydraulically. However, when the end positions of the pistons are reached in the feed cylinders and/or in the drive cylinders, the switching valve is actuated. The delivery of hydraulic fluid to the drive cylinders and to the hydro-cylinder actuating the pipe switch is simultaneous.

Known pumps also include a pressure equalizing line, which includes a check valve, and is coupled to both ends of one of the two drive cylinders in order to correct the stroke thereof. With such stroke correction, the two drive cylinders can be operated synchronously, despite inevitable leakage from the high-pressure to the low-pressure side of the drive cylinder pistons.

For actuating the switching valve, known pumps also provide on the rod-side end of the feed cylinder, in the region of a water box, an electric switching element. The electric switching element furnishes a switching pulse when the feed piston reaches its end position in the water box and, thus, when the respective drive cylinder reaches its bottom end. To obtain a reliable correction of the stroke, the switching contact must be arranged so that when located in its end positions, the piston sufficiently sweeps the length of the pressure equalizing line.

With this type of switching element, however, the leakage and, thus, the correction range depends on the stroke velocity. As a result, the variation in feed quantity is restricted within narrow limits. Also, to be able to satisfy the stringent requirements for feed quantity variation in industrial installations, hydraulic signal sensing on one of the cylinders has been provided to ensure stroke correction independent of the chosen stroke velocity.

With two pressure switching valves located on one drive cylinder on the bottom and rod sides thereof, and with two stroke correction lines on the other drive cylinder, the synchronism of the two cylinders after every second stroke is typically ensured. This is true for bottom-side as well as for rod-side drives With this type of hydraulic signal sensing, however, in the no-load case (i.e., when operating without load or at low pump resistance), the pressure necessary for reversing the pressure switching valves, or the pressure build-up necessary for switching, is reached only in the end position of the drive piston, due to the differential ratio of the drive cylinder. In no-load operation, this leads to the piston striking the cylinder wall in the end position.

It is an object of the present invention, therefore, to provide a control system for two-cylinder thick matter pumps in which a large feed quantity variation is possible and yet a stroke correction without striking the piston against a cylinder wall is ensured.

SUMMARY OF THE INVENTION

The present invention is directed to a control system for a two-cylinder thick matter pump in which a combination of two position signals are provided for triggering the reversal, one of which ensures reliable switching primarily in the low-load range, and the other primarily in the high-load range. As a result, a reliable soft reversal with stroke correction in a wide delivery range can be achieved.

Thus, in accordance with the present invention, at the drive cylinder, which has no pressure equalizing lines, a pressure switching valve, which is spaced by at least a drive piston length on either end thereof, is coupled for actuation of the reversing valve in both directions. At the rod-side end of the feed cylinders, an electric switching system responding to rod-bound triggering elements is provided. The reversing valve can therefore be actuated by the electric switching system in parallel with the pressure switching valves.

Thus, if a sufficient sweep path for delay of the piston arrangement is set, soft switching can be ensured by the additional electric end-position sensing in no-load operation. In load operation, on the other hand, the hydraulic signal sensing, which ensures reliable stroke correction, is preferably used for reversal.

One advantage of the present invention, is that the electronic switching system includes a servo control which acts alternately on one or the other actuation sides of the reversing valve, and is preferably designed as a step-by-step relay. The electronic switching system also includes two proximity switches, each responding to one of the rod-bound triggering elements.

In one control system of the present invention, the reversing valve receives the control pressure on the entry side by means of a servo valve. In parallel with the servo valve, a by-pass valve is provided which operates based on the force of a spring and is controllable by the electric switching system. The by-pass valve increases the control pressure and volume flow at the time of reversal, so that independently of the preselected control pressure at the servo valve, the precontrol pressure behind the reversing valve is increased to a maximum pressure.

Thus, sufficient oil for the precontrol of the reversing valve is available for switching the pipe switch cylinder. At the same time, the reversal of the reversing hydro-pump is accelerated due to the increase in pressure. Hence, the electric switching system facilitates and supports the switching process despite full hydraulic control capability. Thus, even without the electric signal, the pump can continue to run hydraulically, but only with the oil quantity preselected at the servo valve and at the pressure set there.

In another control system of the present invention, a pressure switch is provided for cutting off the electric reversing signals when a predetermined pressure value in the drive cylinders is exceeded.

DETAILED DESCRIPTION

Figure 1A:
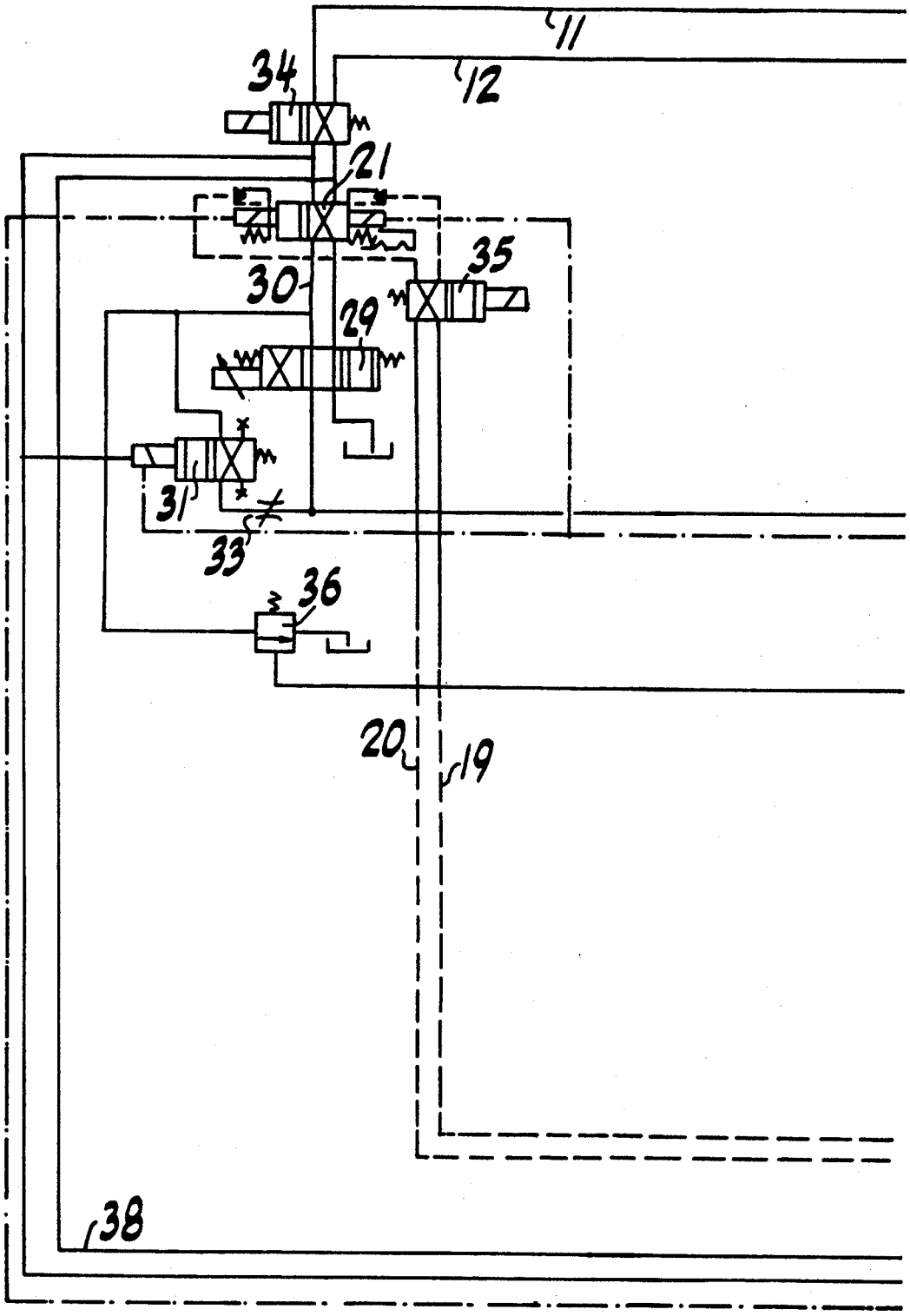
FIGS. 1*a* and 1*b* are a schematic diagram of a control system for a two-cylinder thick matter pump embodying the present invention.
Figure 1B:
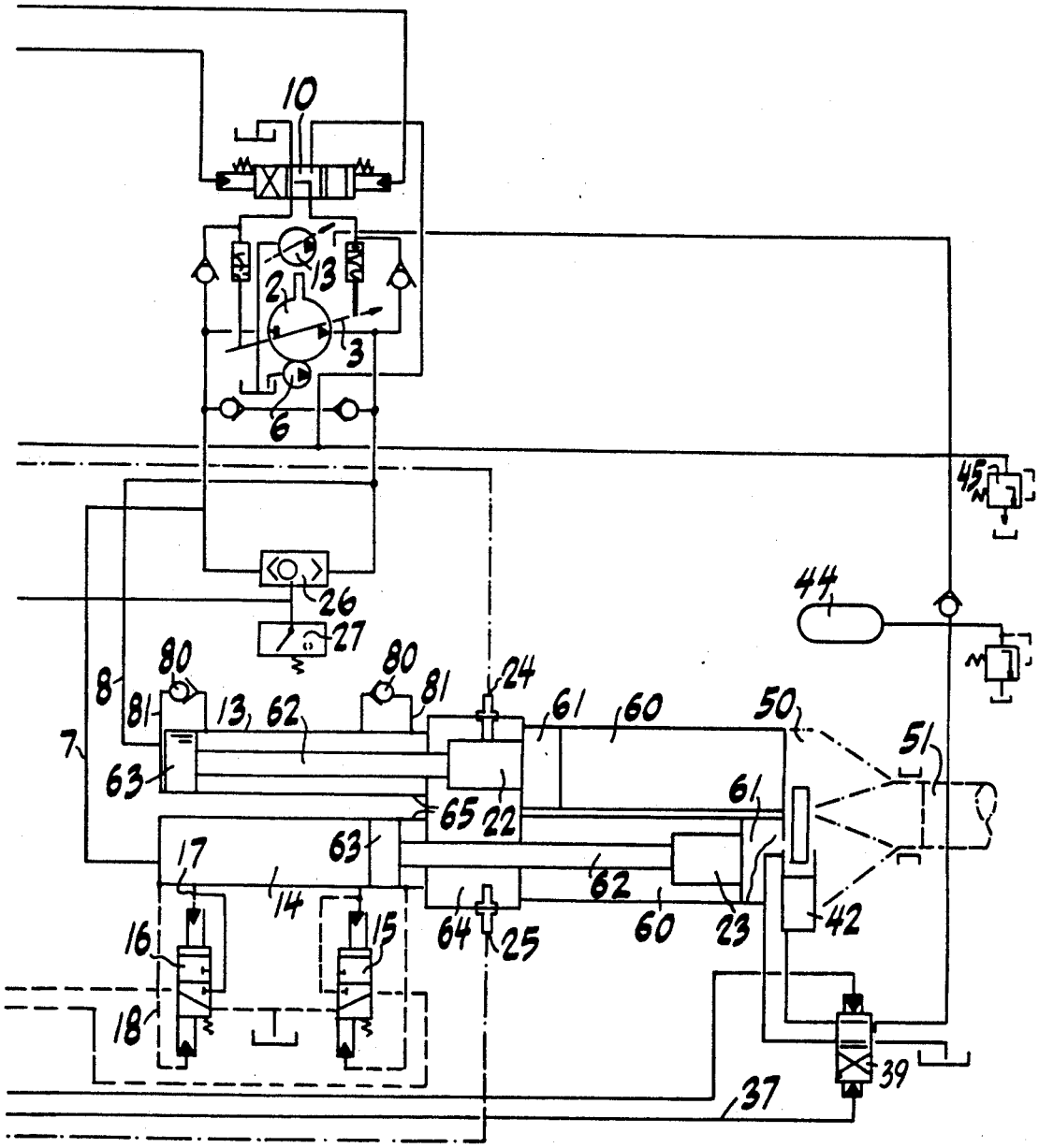

The thick matter pump includes two feed cylinders 60, the end-side openings of which lead into a material charge vessel (not shown), and which alternately can be coupled to a feed line 51 during the pressure stroke by means of a pipe switch 50. The matter is pumped through the feed cylinders 60 in a push-pull manner by hydraulic drive cylinders 13 and 14 and a reversing hydro-pump 2, which in the embodiment of the present invention shown is designed as a swash plate axial piston pump. Two feed pistons 61 are each coupled by means of a respective common piston rod 62 to a respective drive piston 63. Each drive piston 63 is supported and driven within a drive cylinder 13 or 14, respectively. Between the feed cylinders 60 and the drive cylinders 13 and 14 is a water box 64, through which the piston rods 62 drive the feed pistons 61.

On their bottom sides, the drive cylinders 13 and 14 are supplied with pressurized oil by means of pressure lines 7 and 8 which are, in turn, coupled to the at least one swash plate axial piston pump 2. The drive cylinders 13 and 14 are also hydraulically coupled to one another on their rod-side ends by means of a transverse line 65. For the purpose of stroke correction, a pressure equalizing line 81, which bridges the respective drive piston 63 and contains a check valve 80, is coupled to both ends of the drive cylinder 13.

The reversal of the direction of action of the drive pistons 63 in the drive cylinders 13 and 14 is by triggered by a reversing signal. In response to the reversing signal, the swash plate 3 of the axial piston pump 2 swings through the neutral position and, thus, changes the feed direction of the oil in the lines 7 and 8. The axial piston pump 2 operates in a closed cycle and is supplied by a feed pump 6 with sufficient head, which is limited by a low-pressure limiting valve 45.

At a given drive speed, the delivery rate of the axial piston pump 2 is defined by the pivot angle of the swash plate 3. The pivot angle of the swash plate 3 and, hence, the delivery rate is adjustable by controlling the pressure for actuating a proportional valve 10 coupled to lines 11 and 12. The control pressure (for actuating the proportional valve 10) is set at a desired value from a switchboard station, for example, by means of an electrically actuated servo or proportional valve 29.

The servo valve 29 is controlled not only to regulate the control pressure, but also to ensure that there is sufficient control oil available to carry out the reversing phase of the swash plate axial pump 2. As standard servo valves are limited in their flow quantity, a by-pass valve 31 is coupled to the reversing valve 21 in parallel to the servo valve 29. Thus, the by-pass valve 31 admits a sufficient quantity of oil into a line 30 during the reversing phase of the servo valve 29. Accordingly, as a result of this configuration, a rapid reversal of the thick matter pump and pipe switch can be achieved.

The control oil flows through a reversing valve 21, which is actuated both electrically and hydraulically, and through a resetting valve 34 located downstream of the reversing valve 21. The resetting valve 34 directs the control oil either through the line 12 or the line 11, thus bringing about a reversal of the axial piston pump 2.

Actuation of the reversing valve 21 occurs in one instance hydraulically by means of lines 19 and 20, which are coupled to switching valves 16 and 15, respectively. The switching valves 15 and 16 are coupled to either end of the drive cylinder 14, each being located adjacent to a respective end position of the respective drive piston 63. Each valve 15 and 16 is coupled to the cylinder 14 on one end by a line 17 and on the other end by a line 18. When the drive piston 63 reaches its switching positions, the pressure difference between the respective lines 17 and 18 switches the respective valve 15 or 16. The control lines 19 and 20 are, accordingly, alternately pressure-carrying or pressureless lines, respectively.

The reversing valve 21 is, in turn, actuated by means of the pressure change in the control lines 19 and 20 and locks itself in the respective end position. Upon reversal of the valve 21, the control pressure is reversed in the lines 11 and 12 and in lines 37 and 38, which are oriented parallel thereto. The lines 37 and 38 pressurize a switching cylinder 42 by means of a multiple-direction valve 39 and, in turn, switch the pipe switch 50 by means of the hydro-pump 43 and pressure reservoir 44.

If the thick matter pump is run at very low pressures only, a pressure difference must be established before hydraulically switching the valves 15 and 16. In the no-load case, this takes place only in the end position of the respective drive piston 63. If at the same time the machine runs fast, undesirable hard knocks can be caused by the piston striking the bottom or cover walls of the respective cylinders. In addition to these mechanical stresses, however, unduly high hydraulic pressure peaks, additional heating of the oil, and an undesirable interruption in the delivery of thick matter can occur. If, however, a certain pressure level and, hence, a sufficient pressure difference between the lines 17 and 18 is maintained, the reversing pulse travels quickly enough through the lines 19 and 20, so as to prevent the pistons 63 from striking the respective cylinders 13 and 14.

To prevent the pistons from striking the cylinder walls at end of their strokes at low pressures, and particularly in the no-load case, the control system of the present invention provides an electric actuation in parallel with the hydraulic actuation of the reversing valve 21. The electric actuation is achieved by means of electric proximity switches 24 and 25 supported in the region of the water box 64. The proximity switches 24 and 25 are triggered by switching heads 22 and 23 supported on the respective piston rods 62 of each feed piston 61. The proximity switches 24 and 25 are moveable relative to the end positions of the respective switching heads 22 and 23. Thus, the instant at which the electric pulse is generated by each proximity switch 24 and 25, can be preselected within certain limits.

The pulses generated by the switches 24 and 25 are transmitted to the electric actuation inputs of the reversing valve 21 by means of a step-by-step relay (not shown) in a manner within the knowledge of those skilled in the art. At the same time, the high pressure in the respective pressure-carrying lines 7 and 8 is continuously monitored by means of a pressure switch 27 and double check valve 26. The pressure switch 27 is adjusted so that when a predetermined minimum pressure is not achieved, the reversing valve 21 is electrically reversed, exclusively by means of the switches 24 and 25. Additionally (or alternatively), it is possible to set a desired pressure value for the pressure switch 27, above which the electric signal will be disregarded for purposes of actuating the reversing valve 21. The reversal then occurs exclusively by means of the hydraulic pulses from the switching valves 15 and 16.

A safety valve 36 is actuated in parallel with the pressure switch 27 and is precontrolled by the high pressure, in order to provide a pressure cut-off in the high pressure system. As shown in the drawing, when the fluid pressure exceeds the force of a spring within the valve, the valve closes. After the set pressure value is reached, the pump 2 switches to compensate for the decrease in control pressure, i.e., the pivoting angle is reduced.

The switches 24 and 25 also trigger a through-switching of the by-pass valve 31. As described above, the by-pass valve 31 is actuated to produce a control pressure and volume flow increase. The reversal is triggered when one of the two proximity switches 24 or 25 is actuated by the respective switching head 22 or 23. In that instant, the valve 31 is electrically switched through, so that by means of an adjustable throttle 33, the full pressure of the feed pump 6 is behind the proportional valve 29. Independent of the electrically preselected control pressure provided by the valve 29, the precontrol pressure behind the valve 21 is correspondingly increased.

Thus, sufficient oil is available for precontrol of a reversing valve 39 for through-switching the hydrocylinder 42 coupled to the pipe switch 50. Additionally, the increased pressure is applied to the hydraulic proportional valve 10 of the swash plate axial pump 2. Thus, due to this increase in pressure, the swash plate 3 can be pivoted at an increased speed. The valve 31 then drops to its normal position when there is no longer a signal from either the electric switches 24 or 25.

Two 4/2-valves 34 and 35 are necessary when the thick matter pump is switched to return, i.e., to provide suction from the feed line 51. In this case, for reasons of control logic, on the one hand, the hydraulic signal from the two switching valves 15 and 16 and, on the other hand, the signal transmitted to the hydraulic proportional valve 10, are reversed.

We claim:

1. A control system for a pump, the pump having two hydraulic drive cylinders, two pistons supported and driven within each respective drive cylinder, and two feed cylinders, each feed cylinder being adapted to receive a respective piston therein, the pistons being adapted to feed matter from a material vessel through the feed cylinders and a pipe switch and, in turn, into a feed line, the pipe switch being pivotable so as to be open to the feed line during the pressure stroke and be open to the vessel during the suction stroke, comprising:

first means for delivering hydraulic fluid to the drive cylinders to drive the pistons therein;

second means coupled to the first means for actuating the pipe switch;

a reversing valve coupled to the first means and second means and adapted to be actuated upon a respective piston reaching the end of its stroke to, in turn, reverse the direction of hydraulic fluid flowing to or from each respective drive cylinder and the pipe switch;

a pressure equalizing line extending from one end of one of the drive cylinders towards the other end of the cylinder, and including a check valve therein for correcting the stroke of the piston driven within the respective drive cylinder;

two pressure switching valves, each pressure switching valve being coupled to one end of the other drive cylinder and to the reversing valve for actuation thereof in response to a change in pressure in the respective end of the drive cylinder; and third means supported near the ends of the feed cylinders adjacent to the drive cylinders and electrically coupled to the reversing valve for actuating the reversing valve in parallel with the pressure switching valves, the third means being responsive to the triggering elements coupled to each respective piston to actuate the reversing valve upon one of the pistons reaching the end of its stroke in the direction toward the respective drive cylinder.

2. A control system as defined in claim 1, wherein the reversing valve is adapted to lock into position upon actuation thereof until subsequently actuated.

3. A control system as defined in claim 1, wherein the third means includes a servo control coupled to and adapted to actuate the reversing valve.

4. A control system as defined in claim 1, wherein the third means includes two proximity switches, each proximity switch being supported near the end of a respective feed cylinder adjacent to the respective drive cylinder and responsive to a triggering element on the respective piston to generate an output signal for actuating the reversing valve upon the respective piston reaching the end of its stroke.

5. A control system as defined in claim 1, further comprising:

a servo valve coupled to the reversing valve and adapted to direct the flow of hydraulic fluid at a predetermined control pressure; and a by-pass valve coupled to the reversing valve and oriented in parallel relationship with the servo valve, to by-pass the servo valve upon actuation of the third means.

6. A control system as defined in claim 5, further comprising:

a throttle valve coupled to the by-pass valve for limiting the volume of hydraulic fluid flowing therethrough; and a pressure limiting valve coupled between the by-pass valve and the reversing valve for limiting the flow of hydraulic fluid therethrough upon the fluid exceeding a predetermined pressure.

7. A control system as defined in claim 1, further comprising:

a pressure switch coupled to at least one drive cylinder to monitor the pressure thereof and coupled to the reversing valve, the pressure switch being adapted to prevent the transmission of signals from the pressure switching valves to the reversing valve upon the pressure in the drive cylinder falling below a predetermined level.

8. A control system as defined in claim 1, further comprising:

a pressure switch coupled to at least one drive cylinder to monitor the pressure thereof, the pressure switch being adapted to prevent the transmission of signals from the third means to the reversing valve upon the pressure in the respective drive cylinder exceeding a predetermined value.

9. A control system as defined in claim 1, wherein the first means includes a hydro-pump coupled to the drive cylinders for delivering hydraulic fluid thereto.

10. A control system as defined in claim 9, wherein the hydro-pump is a swash plate axial piston pump.

11. A control system as defined in claim 1, wherein the first means includes several reversing hydro-pumps oriented in parallel relationship to each other and coupled to the reversing valve, the pumping direction of each hydro-pump being reversed upon actuation thereof.

* * * * *